US005669439A

United States Patent [19]

Hasegawa et al.

[11] Patent Number: 5,669,439

[45] Date of Patent: Sep. 23, 1997

[54] LAMINATED TYPE HEAT EXCHANGER

[75] Inventors: Etsuo Hasegawa, Konan; Masatoshi Sudo, Kariya; Toshiya Nagasawa, Obu; Keiichi Yoshii, Anjo, all of Japan

[73] Assignee: Nippondenso Co., Ltd., Kariya, Japan

[21] Appl. No.: 635,006

[22] Filed: Apr. 19, 1996

[30] Foreign Application Priority Data

Apr. 21, 1995 [JP] Japan ..... 7-96945

[51] Int. Cl.[6] ..... F28D 1/02

[52] U.S. Cl. ..... 165/153; 165/152; 165/176; 62/515

[58] Field of Search ..... 165/153, 152, 165/176; 62/515

[56] References Cited

U.S. PATENT DOCUMENTS

| | | | |
|---|---|---|---|
| 4,723,601 | 2/1988 | Ohara et al. | 165/153 |
| 5,058,662 | 10/1991 | Nguyen | 165/153 X |
| 5,137,082 | 8/1992 | Shimoya et al. | 165/153 X |
| 5,172,759 | 12/1992 | Shimoya et al. | 165/153 X |

FOREIGN PATENT DOCUMENTS

| | | | |
|---|---|---|---|
| 62-798 | 1/1987 | Japan . | |
| 0057095 | 3/1989 | Japan | 165/153 |
| 4000163 | 1/1992 | Japan | 62/515 |
| 5106939 | 4/1993 | Japan | 62/515 |
| 6066457 | 3/1994 | Japan | 62/515 |
| 6123578 | 5/1994 | Japan | 165/153 |

*Primary Examiner*—John Rivell
*Assistant Examiner*—Christopher Atkinson
*Attorney, Agent, or Firm*—Cushman, Darby & Cushman IP Group of Pillsbury Madison & Sutro LLP

[57] ABSTRACT

According to the present invention, an outlet tank and an inlet tank are formed in one end side of a plurality of connecting bodies and the bent portions are formed in other end side of the connecting bodies. The plurality of the connecting bodies is formed by a pair of pressed plates and is laminated to form a predetermined space in which the fin is installed, thus creating a laminated type heat exchanger. The bent portions are formed in a bottom end portion of the connecting body, and in the remaining bottom end portion of the surface, there is formed an extending portion which extends to a side lower than the bottom end portion of the fin. Therefore, even when the condensed water becomes a water drop between the surface of the connecting body and the surface of the fin, the drop does not stay for a long time and is efficiently drained by the extending portion downwardly.

5 Claims, 7 Drawing Sheets

LAMINATED TYPE HEAT EXCHANGER

CROSS-REFERENCE TO RELATED APPLICATION

This application is related to and claims priority from Japanese Patent Application No. Hei. 7-96945 filed on Apr. 21, 1995, the contents of which is hereby incorporated by reference.

BACKGROUND OF THE INVENTION

1. Field of the Invention

The present invention relates to a laminated type heat exchanger. More particularly, the present invention is preferably applied to a laminated type refrigerant evaporator.

2. Description of Related Art

A conventional refrigerant evaporator is disclosed in JP-A-62-798, for example.

The evaporator disclosed in JP-A-62-798 is briefly described with reference to FIG. 8. In FIG. 8, a fin 123 is brazed on the front side of plate 100, which will be described later. That is to say, a surface of a connecting body is disclosed.

As shown in FIG. 8, in the plate 100' of the evaporator, there is formed a depression portion 101 for forming a passage, which is formed in a U-shape by pressing, so as to protrude toward the front side of the paper in FIG. 8. Since the depression portion 101 forms the U-shaped passage, a partition rib 102 is formed in the center portion of the plate 100' so as to protrude toward the back side of the paper in FIG. 8. Further, in the depression portion 101 forming the passage, plural ribs 103 are formed so as to protrude toward the back side of the paper in FIG. 8.

At both ends of the depression portion 101 for forming the U-shaped passage, there are formed a depression portion 104 for forming a first tank and a depression portion 105 for forming a second tank, both of which have a deeper depression amount than the depression portion 101, so as to protrude toward the front side of the paper in FIG. 8. At the bottom of the depression portion 104 for forming the first tank 104, there is formed a first communicating hole 106 having a roughly ellipsoidal shape, so as to pass therethrough. Moreover, at the bottom of the depression portion 105 for forming the second tank, there is formed a second communicating hole 107, having a roughly ellipsoidal shape, so as to pass therethrough.

Further, at the periphery of the depression portion forming passage 101, there is formed a peripheral rib 108 so as to protrude toward the back side of the paper in FIG. 8. At the bottom side end portion (the down side in FIG. 8) of plate 100 in the peripheral rib 108, a first bent portion 111 and a second bent portion 112, both of which are bent to be substantially perpendicular to the front side of the paper in FIG. 8, are integrally formed to fixedly hold the fin 123, which will be described later.

The evaporator disclosed in JP-A-62-798 has a bent portion whose shape is actually different from the first bent portion 111 and the second bent portion 112 in FIG. 8; however, it basically has the same function.

Further, the connected body is formed by connecting a pair of the plate 100 face to face, in which one bent portion 111 or 112 faces to the other bent portion 112 or 111. Specifically, one peripheral rib 108 contacts the other peripheral rib 108 and one partition rib 102 contacts the other partition rib 102. Then, the plurality of connecting bodies are laminated in such a manner that all of the first communicating holes of the connecting bodies communicate with each other and all of the second communicating holes of the connecting bodies communicate with each other, so as to form a gap between each adjacent surface of the plurality of connecting bodies at the lower end side, and the front surface of the second bent portion 112 of one connecting body is overlaid on the back side surface of the first bent portion 111 of the other connecting body.

As shown in FIG. 3, in the space between a pair of the adjacent connecting bodies, the fin 123 for facilitating heat exchange of the refrigerant with air is positioned between the depression portions 104 and 105 forming each tank and the bent portions 111 and 112. Further, two side plates 131 and 132 are installed on each end of the evaporator 6. An inlet pipe 121 communicating with the first communicating hole 106 is connected to an outlet pipe 122 communicating with the second communicating hole 107, and finally, these are integrally brazed to form a refrigerant evaporator 6.

Since the first bent portion 111 and the second bent portion 112 are laid to overlap each other, a long plate is provided at the bottom side of the connecting bodies. Because the plate regulates movement of the fin 123, it is prevented that the fin 123 is dropped off outside when producing the evaporator or that the evaporator is buckled.

However, since a long plate is provided at the bottom side of the connecting bodies which are laid to overlap each other, the plate may be horizontally placed when the evaporator is mounted on a vehicle. Thus, condensed water falling along the surfaces of the plate 100 and the fin 123 stays on the horizontal plate, and the condensed water is not drained from the bottom outside. As a result, there is a problem that rust is generated on the bottom of the evaporator due to the condensed water staying on the plate.

SUMMARY OF THE INVENTION

In view of the above-described problems, it is an object of the present invention to provide a laminated type heat exchanger which fixedly holds a fin by a bent portion and can effectively drain condensed water generating on surfaces of a connecting body and the fin.

According to the present invention, an outlet tank and an inlet tank are formed in one end side of the plurality of connecting bodies, and the bent portions are formed in other end side of the connecting bodies. The plurality of connecting bodies are formed by laminating a pair of pressed plates so as to form a predetermined space in which the fin is installed, and thus the laminated type heat exchanger is structured. When a refrigerant flows into inlet tank of each the connecting body, the refrigerant flows in a U-shaped tube, then, the refrigerant flows together in the outlet tank portion and is discharged therefrom. When the heat of the refrigerant of the connecting body is exchanged with the outside air, the moisture of the air is condensed to form the condensed water, and the condensed water is adhered on the surface of the connecting body and the fin.

Since the bent portions are formed on the bottom end portion of the surface of the connecting body, and the fin is installed between the bent portions and the two tanks, the fin is regulated by the bent portions, even when the laminated type heat exchanger is disposed in such a manner that the two tanks are positioned at an upper side and the bent portions are positioned at a lower side. Thus, it is prevented that the fin is dropped off outside.

The bent portions are formed in a bottom end portion of the connecting body, and further, in the remaining bottom end portion of the surface, there is formed an extending portion which extends to a side lower than the bottom end portion of the fin. Therefore, even when the condensed water becomes a water drop between the surface of the connecting body and the surface of the fin, the drop does not stay for a long time and is efficiently drained from the extending portion downwardly.

More preferably, the guide groove may be formed on a bottom portion of the connecting body. When the condensed water, which is generated on the surface of the connecting body, flows to drop on the surface of the connecting body, with the guide groove, the condensed water is guided to the extending portion while avoid the bent portions. Therefore, it is prevented that the condensed water stays on the bent portions, as a result, it is possible to prevent rusting of the bent portion. Further, since the surface of the back side of the guide groove of the plate can be used as a connecting surface, for example, one surface of the plate formed by pressing can be used as the guide groove and the back surface, i.e., the other surface, of the plate can be used as the connected surface.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PRESENTLY PREFERRED EXEMPLARY EMBODIMENTS

Preferred embodiments of the present invention are described hereinafter with reference to the accompanying drawings.

A first embodiment where the present invention is applied to a refrigerant evaporator of an automotive air conditioner is described with reference to FIG. 1 to 6.

Figure 1:
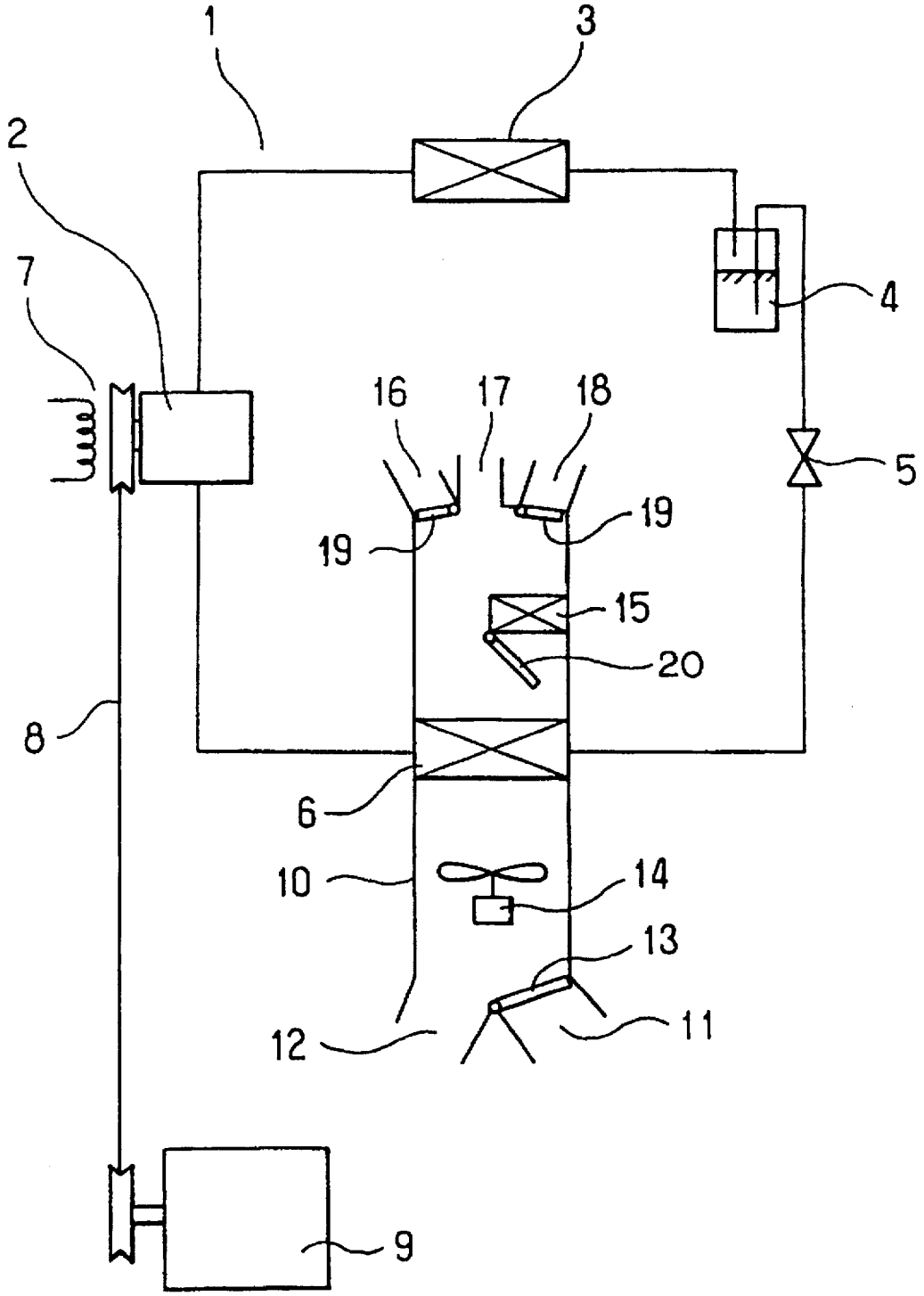
FIG. 1 is a schematic diagram showing a refrigerating cycle and a ventilation system according to a first embodiment of the present invention.

As shown in FIG. 1, the refrigerating cycle 1 is formed with: a compressor 2 for sucking, compressing, and discharging a refrigerant; a condenser 3 for condensing the high pressure refrigerant from the compressor 2; a receiver 4 for discharging only a liquid refrigerant out of the gaseous-liquid refrigerant from the condenser 3; an expansion valve 5 (decompression means) for expanding the refrigerant from the receiver 4; and an evaporator 6 for evaporating the refrigerant from the expansion valve 5.

Further, the compressor 2 is connected to an automotive engine 9 via a magnet clutch 7 and a belt 8. When the magnet clutch 7 is turned on by supplying electric current thereto, the rotating force of the automotive engine 9 is transferred to the compressor 2.

Further, the evaporator 6 is disposed in an air conditioning duct 10 (air passage) which communicates with a passenger compartment. At an upstream side of the air conditioning duct 10, there are formed an inside air inlet 11 for sucking inside air of the passenger compartment and an outside air inlet 12 for sucking outside air. These inlets 11 and 12 are selectively opened and closed by an inside/outside air switching means 13. At the downstream side of the inlets 11 and 12, there is provided a blowing means 14 for sucking the inside air or the outside air and blowing into the passenger compartment.

Further, heating means 15 for heating the air is installed in the air conditioning duct 10 at the downstream side of the evaporator 6. At the downstream end side of the air conditioning duct 10, there are formed a defroster outlet 16 for directing the conditioned air toward the inner surface of the windshield of the automobile, a face outlet 17 for directing the conditioned air toward the upper half body of a passenger in the passenger compartment and a foot outlet 18 for directing the conditioned air toward the lower half body of a passenger in the passenger compartment. These outlets are opened and closed by an outlet switching means 19.

When the magnet clutch 7 is turned on to drive the compressor 2, the evaporator 6 dehumidifies and cools the air from the blowing means 14, and temperature of the cool air is controlled by an air mix door (temperature adjusting means) 20. Then, the conditioned air directs into the passenger compartment from any of the outlets 16–18.

Figure 2:
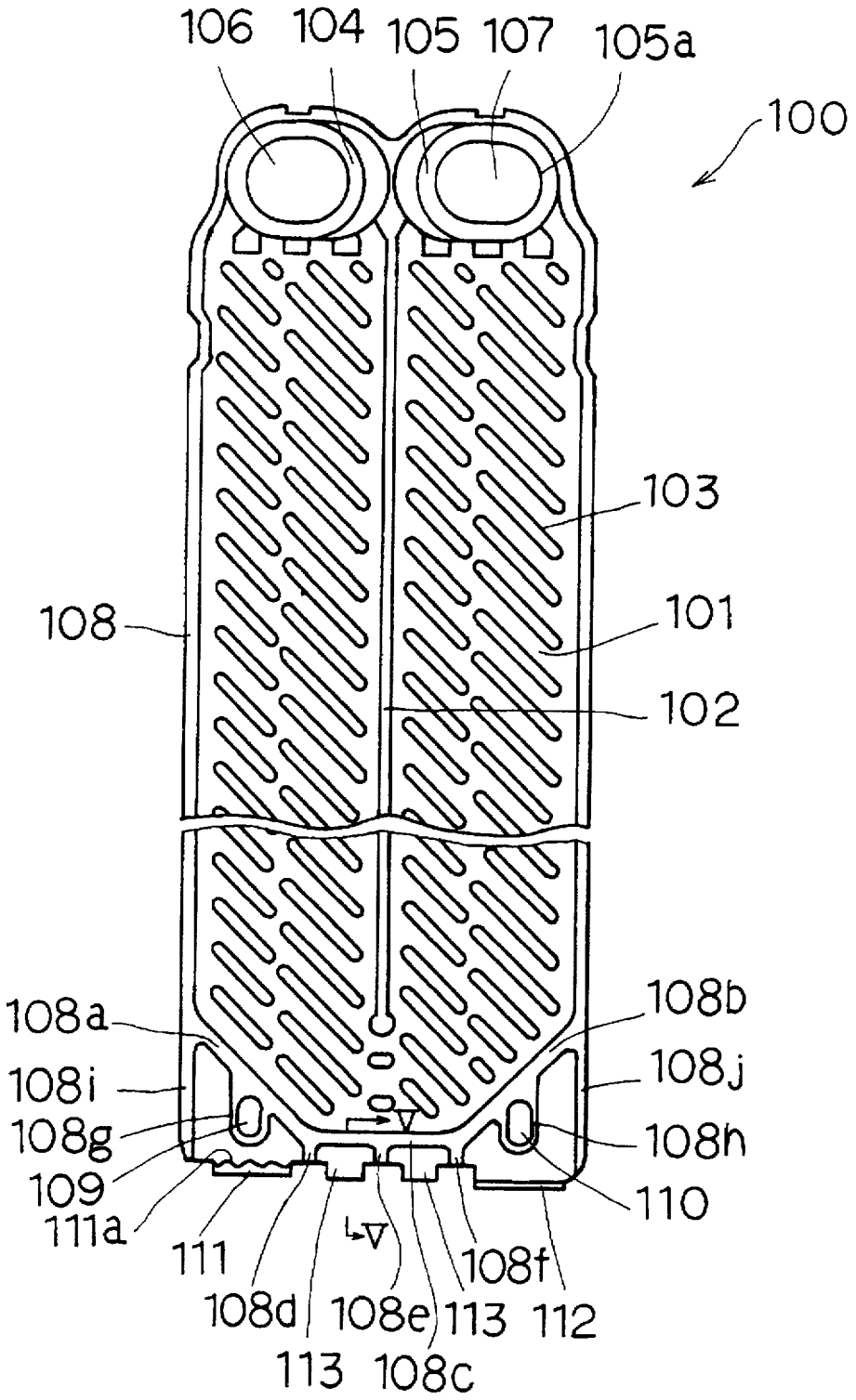
FIG. 2 is a front view showing a plate 100 in the embodiment.
Figure 8:
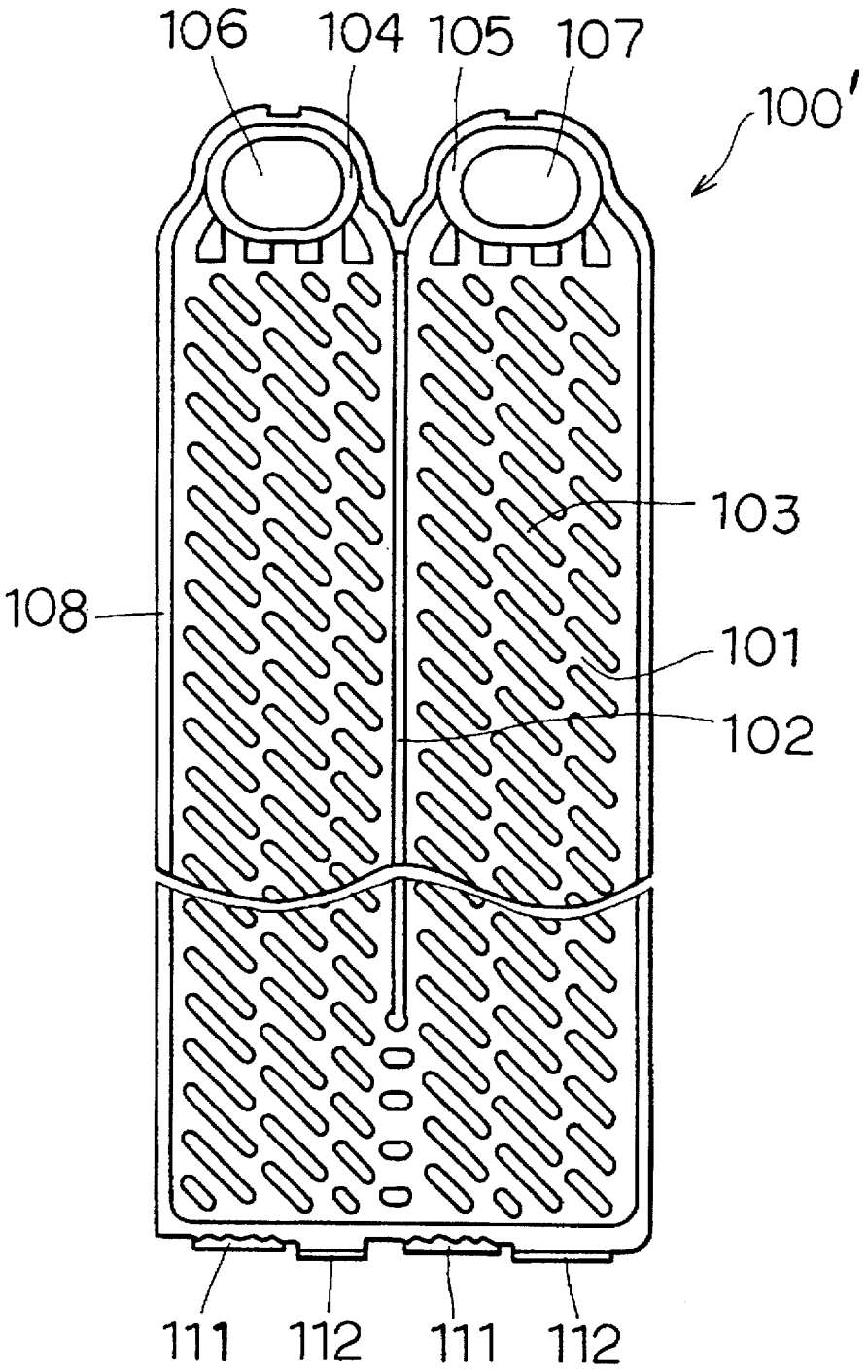
FIG. 8 PRIOR ART
FIG. 8 is a front view showing a plate of the conventional type.

Next, a concrete structure of the evaporator 6 will be described with reference to FIGS. 2 to 6. In FIG. 2, the same portions, which are equivalent to those in FIG. 8, are shown with the same reference numerals, and the explanation is omitted.

In FIG. 2, the thickness of the plate 100 is 0.5–0.6 (mm), and the plate 100 is made of a clad material, both surfaces of which are cladded. Specifically, a core of the plate 100 is made of A3003 material, for example, the surface is cladded with A4104 material, and the plate 100 is formed by pressing a plate material in which the clad ratio of one side is 10~15%.

In the plate 100, there are formed a depression portion 101 for forming a passage; a partition rib 102; a rib 103; a depression portion 104 for forming a first tank; a depression portion 105 for forming a second tank; a first communicating hole 106; and a second communicating hole 107. Further, at a peripheral portion of the second communicating hole 107, there is formed a flange portion **105*a* so as to protrude toward the front side of paper in FIG. 2. When plural connecting bodies 400, each of which is formed by connecting a pair of plates 100 face to face, are laminated, the laminated position is determined by the flange portion 105*a***.

Further, at the periphery of the depression portion 101 for forming a passage, there is formed a peripheral rib 108 so as to protrude toward the back side of paper in FIG. 2. When the bottom portion of the plate 100 (the opposite side to the communicating holes 106 and 107) in the peripheral rib 108 is divided into approximately three portions in the width direction of the plate 100 (the horizontal direction in FIG. 2), the left and right two side portions form two slant shape ribs **108*a* and 108*b*, and the remaining center portion forms a horizontal rib 108*c*** which is horizontally formed.

Further, in the horizontal rib **108*c*, there are formed ribs 108*d*–108*f* from the horizontal rib 108*c* to the bottom end portion of the plate 100. Further, in the slant shape ribs 108***a* and 108*b*, there are formed ribs 108*g* and 108*h* in a roughly ellipsoidal shape. Inside of the ribs 108*g* and 108*h*, air communicating holes 109 and 110 formed in a roughly ellipsoidal shape are provided. Reinforcing ribs 108*i* and 108*j* are provided at each side portion.

Further, in the bottom end portion of the the plate 100 of down side of the slant shape rib 108*a*, there is formed a first bent portion 111 which is bent nearly perpendicularly toward the front side of the paper in FIG. 2 to fixedly hold a fin 123. Further in the bottom end portion of the plate 100 of down side of the slant rib 108*b*, there is formed a second bent portion 112 which is bent nearly perpendicularly toward the front side of the paper in FIG. 2.

In this embodiment, when plural connecting bodies 400 (FIG. 3) are laminated to form the evaporator 6, on the top surface of the second bent portion 112 of each connecting body 400, the back surface of the first bent portion 111 of the adjacent connecting body 400 is laid to overlap. Thus, in the evaporator 6 where plural connected bodies 400 are laminated, the movement of the fin 123 is regulated by the top surface 111*a* of the first bent portion 111, and therefore, the fin 123 is certainly placed in an upper portion than the top surface 111*a* of the bent portion 111.

Further, at the end portion of the plate 100 between the rib 108*d* and rib 108*e*, and at the end portion of the plate 100 between the rib 108*e* and rib 108*f*, protruding pieces 113 are provided so as to be placed in the same horizontal position as the top surface 111*a* of the first bent portion 111, i.e., in a lower position than the bottom end of the fin 123 (the position shown by double-dashed line B in FIG. 5) so as to protrude a predetermined distance toward the down side in FIG. 2.

Then, a pair of the plates 100, each formed by pressing, are connected face to face in such a manner that one bent portion 111 or 112 faces to the other bent portion 112 or 111 (specifically, the peripheral ribs 108 connect with each other, the partition ribs 102 connect with each other, and the ribs 103 connect with each other).

Figure 3:
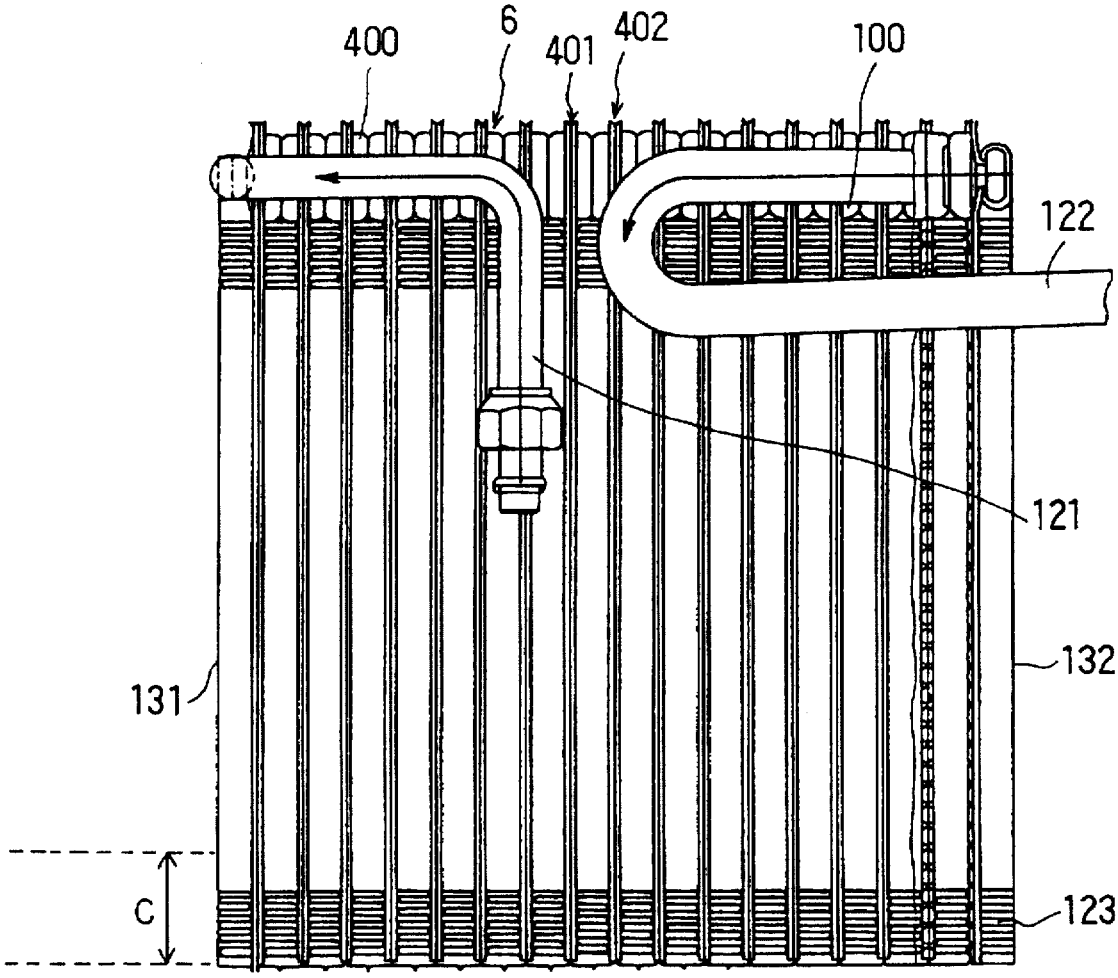
FIG. 3 is a front view entirely showing a refrigerant evaporator in the embodiment.
Figure 4:
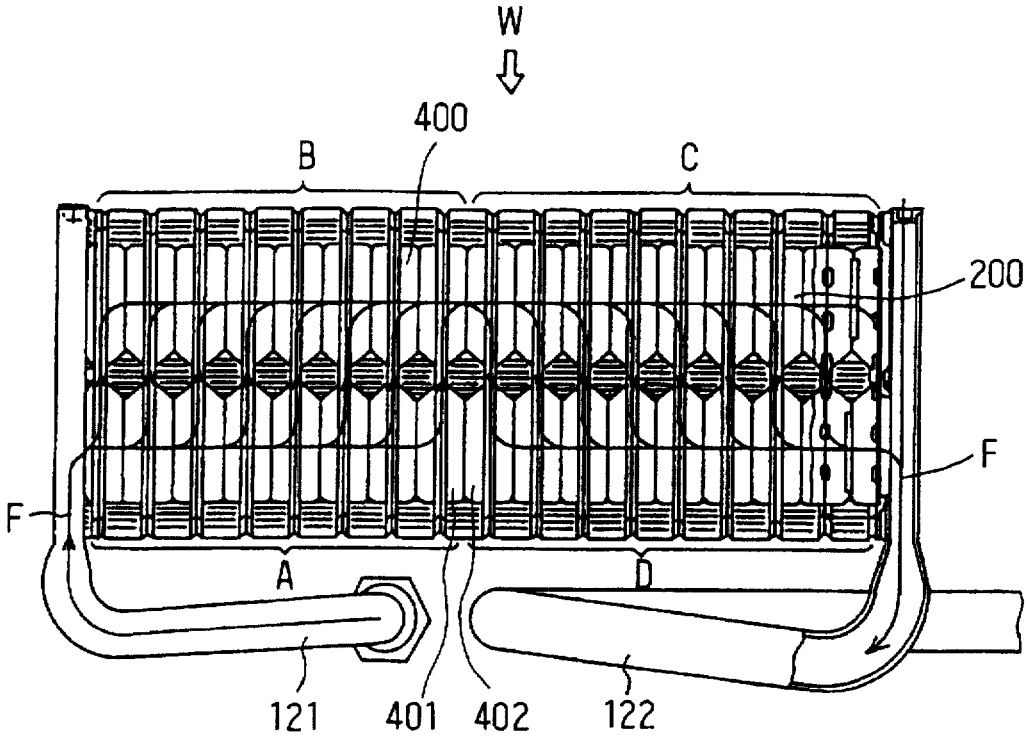
FIG. 4 is a top plan view showing the refrigerant evaporator in FIG. 3.

Further, as shown in FIG. 3 and FIG. 4, the plural connecting bodies 400 are laminated 40 each other in such a manner that the communicating hole 106 of each connecting body 400 communicates with the communicating hole 107 of each connecting body 400. The corrugate fin 123, two side plates 131 and 132, an inlet pipe and an outlet pipe are formed as described above, and these are integrally brazed in a furnace, thus the evaporator 6 being integrally structured. Further, the evaporator 6 is disposed in an air conditioning duct 10 in such a manner that the communicating holes 106 and 107 are placed at an upper position in the gravity force direction and the protruding pieces 113 are placed at a lower position in the gravity force direction.

Since the first communicating hole 106 communicates with the depression portion 104 for forming the first tank of each connecting body 400, a roughly-cylindrical tank extending in a longitudinal direction is formed in the evaporator 6. Further, since the second communicating hole 107 communicates with the depression portion 105 for forming the second tank, a roughly-cylindrical tank extending in the longitudinal direction is formed in the evaporator 6. Further, the depression portion 101 for forming a passage forms a refrigerant passage in which tanks communicate with each other, and a tube is thereby formed.

In the connecting surface between two connecting bodies (connecting bodies 401 and 402) which are nearly positioned in a center position in the laminating direction of the evaporator 6 where plural connecting bodies 400 are laminated, since the first communicating hole 106 is closed, the refrigerant having flowed into the first tank "A", which is formed at the side of the inlet pipe 121 rather than the connecting surface, flows into the second tank "B" through the U-shaped depression portion 101 for forming a passage without flowing into the fourth tank "D", which is formed at the side of the outlet pipe 122 rather than the connected surface.

As shown by arrow "F" in FIG. 4, the refrigerant from the inlet pipe 121 flows into the first tank "A", and then the refrigerant from the first tank "A" is distributed to each depression portion 101 for forming a passage (tube) and flows together in the second tank "B", and therefore, the first tank "A" constructs an inlet tank and the second tank "B" constructs an outlet tank. Further, the refrigerant having flowed together in the second tank "B" flows into the third tank "C", then, the refrigerant from the third tank "C" is distributed to each depression portion forming passage 101 (tube) to aggregate to the fourth tank D, and therefore, the third tank "C" constructs an inlet tank and the fourth tank "D" constructs an outlet tank.

Next, an operation of the above-described structure will be described.

In the ventilation system, the inside air, or outside air which is selected by the inside-outside air change mean 13, is sucked into the air conditioning duct 10 by the blowing means 14, and the sucked air is sent into the evaporator 6. Then, the air passes through the evaporator 6, the temperature of the air is controlled by the air-mix door 20, and the conditioned air is directed into the passenger compartment from the outlets 16–18.

At this time, the refrigerating cycle 1 is operated, the gaseous-liquid two-phase refrigerant flows from the inlet pipe 121 into the first tank "A" and is distributed to each depression portion 101 for forming a passage. Then, the refrigerant which is distributed to each depression portion 101 for forming a passage flows in a U-shape through the depression portion 101 while absorbing the heat from the air in the air conditioning duct 10, and the refrigerant flows together in the second tank "B".

Further, the refrigerant in the second tank "B" flows into the third tank "C" and is distributed to each depression portion 101 for forming a passage. Then, the refrigerant distributed to each depression portion 101 for forming a passage further flows in a U-shape through the depression portion 101 while absorbing the heat from the air in the air conditioning duct 10, and the refrigerant flows together in the fourth tank "D". Then, the refrigerant flows out of the outlet pipe 122, and the refrigerant is sucked into compressor 2.

Since the refrigerant flowing in the depression portion 101 for forming a passage absorbs the heat from the air in the air conditioning duct 10, the moisture of the air condenses, and the condensed water adheres to the surface of each plate 100 and the surface of the fin 123 of the evaporator 6. Almost the condensed water which generates on these surfaces gathers together on the horizontal rib 108*c* falling on the rib 103, the partition rib 102 and the slant ribs 108*a* and 108*b*.

Thus, the condensed water gathers together on the center horizontal rib 108 so as to avoid the first bent portion 111 and the second bent portion 112 and is further distributed to each ribs 108*d*–108*f* and reaches to the bottom portion of the plate 100. Then, along the slant wall of the protruding piece 113, the condensed water reaches to end portion 113*a* of the protruding piece 113, and is drained from the end portion 113*a* toward the down side.

Figure 5:
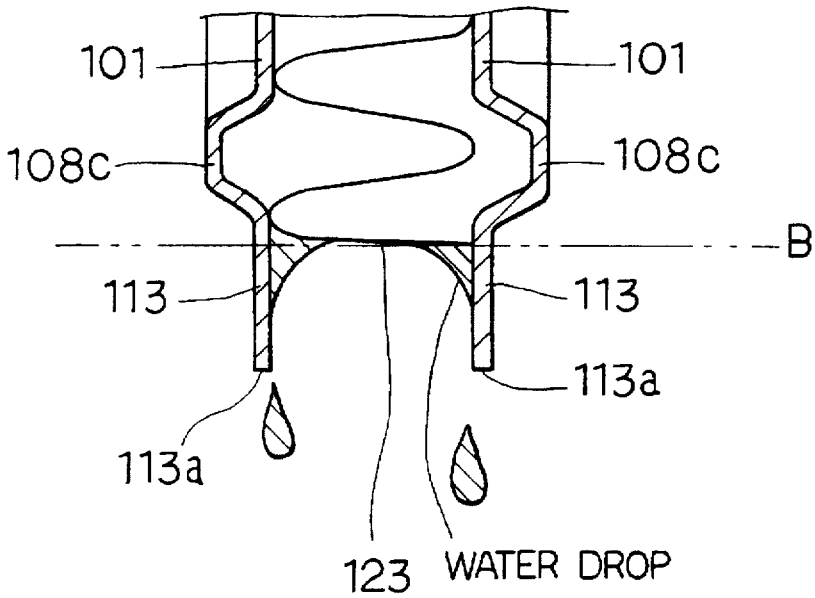
FIG. 5 is a cross-section view showing the evaporator 6 taken along the V—V line of FIG. 2.

FIG. 5 is a cross-section view showing the evaporator 6 taken along the V—V line of FIG. 2. As shown in FIG. 2, a part of the condensed water which is generated on the surface of the fin 123 becomes a water drop between the protruding piece 113 and the fin 123. Because the protruding piece 113 from the position (the position shown by a chain double-dashed line B) which is the top surface 111*a* of the first bent portion 111 extends a predetermined distance so as to protrude toward the down side, the water drop is drained from the end portion 113*a* of the protruding piece 113 without staying for a long time in the space between the protruding piece 113 and the fin 123.

Figure 6:
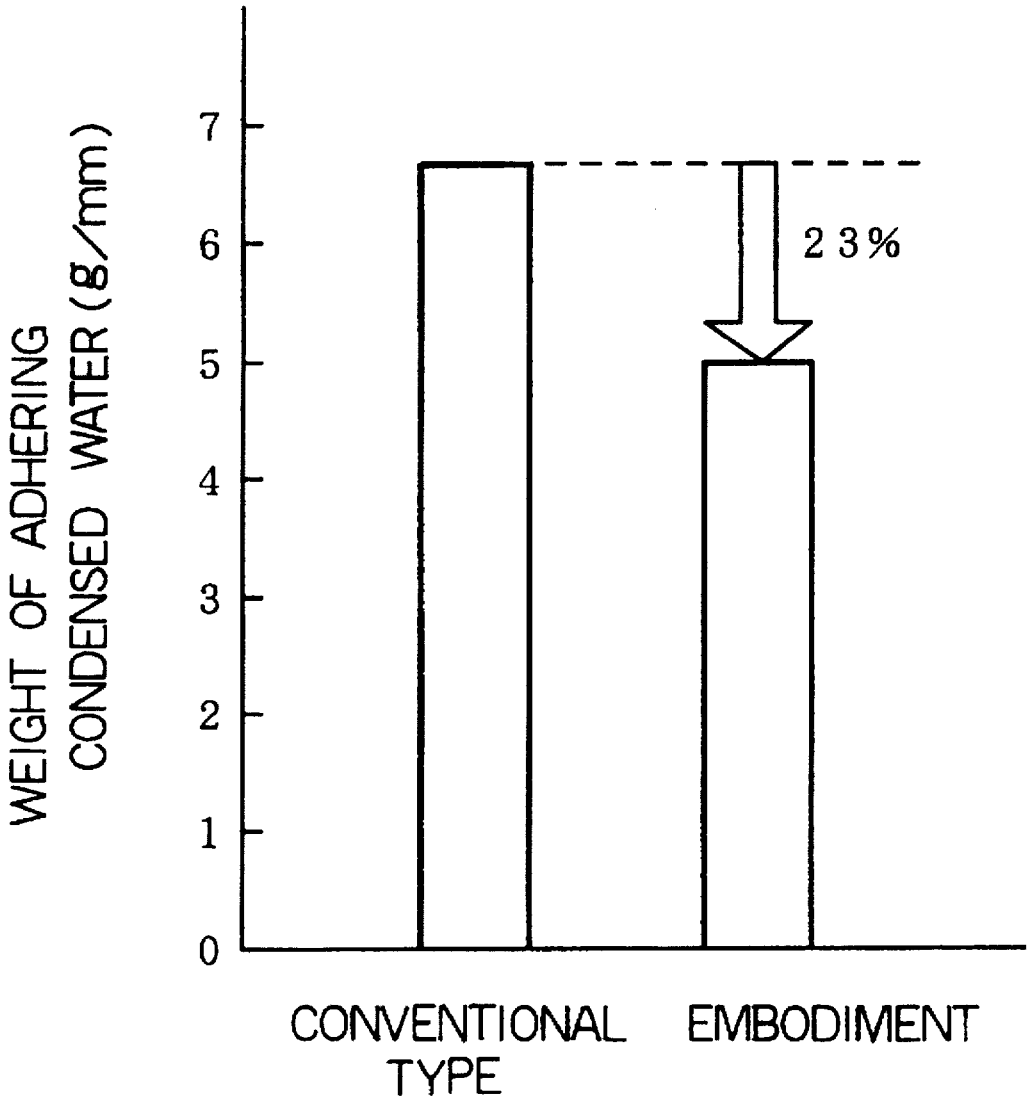
FIG. 6 is an experimental data showing a weight of a condensed water adhering on a predetermined area at the bottom side of the refrigerant evaporator.

In FIG. 6, experimental data is shown to explain how much condensed water adhered in a predetermined area (the area shown by arrow C in FIG. 3) of the bottom side of the refrigerant evaporator 6 when the refrigerating cycle 1 is operated. In FIG. 6, the conventional plate 100' (FIG. 8) and the refrigerant evaporator 6 using the plate 100 of the embodiment (FIG. 2) are used in the experimental refrigerant evaporator 6. As can be understood from the experimental data, according to the embodiment, the weight of the condensed water adhering on the predetermined area is decreased approximately 23% as compared with the conventional type.

As described above, in the laminated type heat exchanger according to the foregoing embodiment, since the bent portions 111 and 112 are only located in the left and right sides in FIG. 2 of the bottom side end portion of the plate 100, and the protruding piece 113 is located in the center portion of the bottom end portion of plate 100 in FIG. 2, the fin 123 can be fixedly held by the bent portions 111 and 112, and the condensed water can be efficiently drained from the protruding piece 113.

In the laminated type heat exchanger according to the foregoing embodiment, since the slant ribs 108*a* and 108*b* are formed in the upper position of the bent portions 111 and 112, and the slant ribs 108*a* and 108*b* communicate with the horizontal rib 108*c* which is formed in the upper position of the protruding piece 113, the condensed water which is generated on the surface of the plate 100 and the fin 123 can flow together on the protruding piece 113 while avoiding the bent portions 111 and 112. Thus, it is possible for the condensed water not to stay on the bent portions 111 and 112, and to improve an effect for preventing rusting of the evaporator 6.

Figure 7:
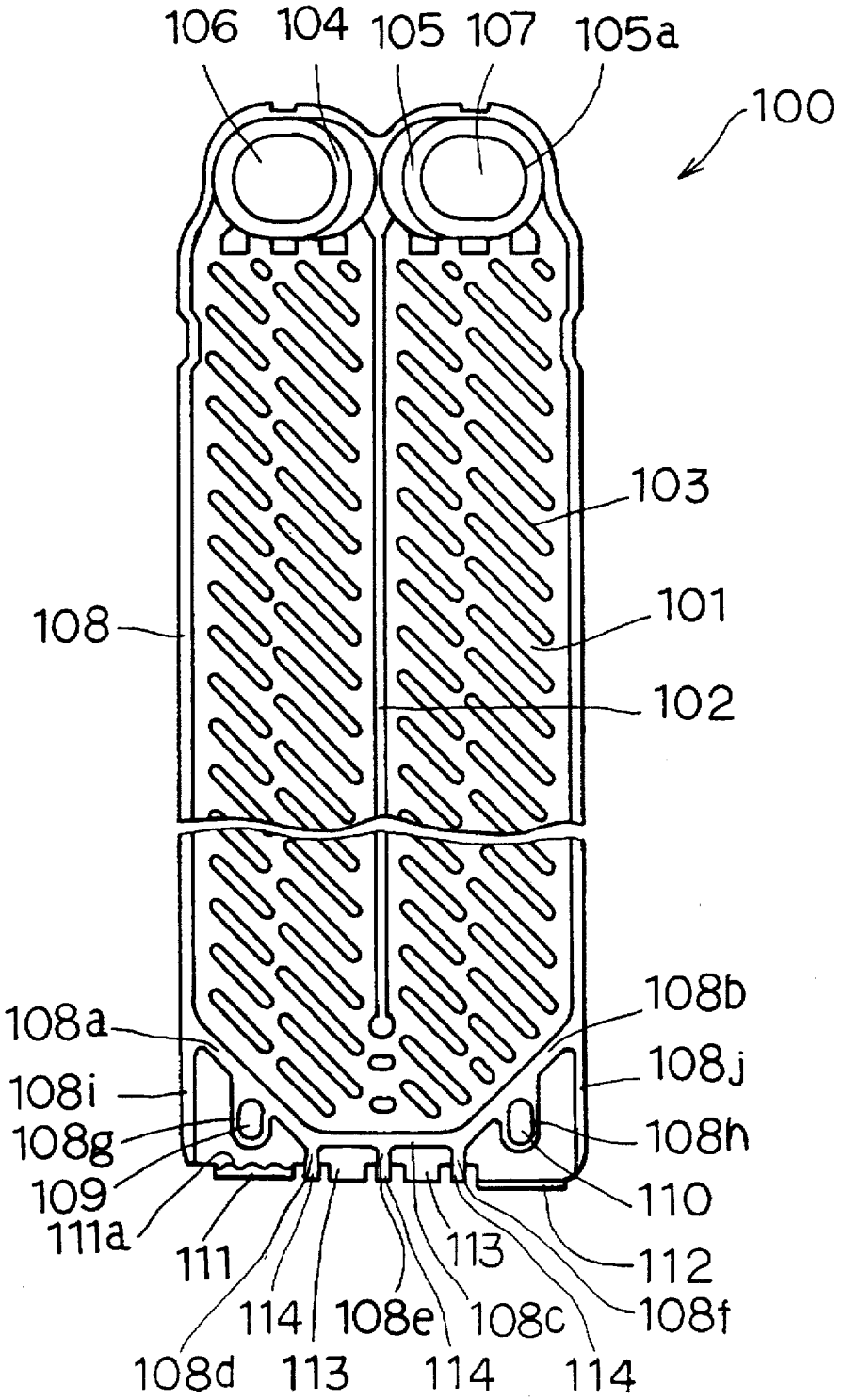
FIG. 7 is a front view showing a plate of a modification.

The present invention is not limited to the foregoing embodiment. As shown in FIG. 7, a protruding piece 114 which protrudes a predetermined distance from the position shown by the double-dashed line B in FIG. 5 toward the down side in FIG. 7 may be also located in the end portions of the ribs 108*d*–108*f*. Thus, the condensed water flowing through the ribs 108*d*–108*f* is efficiently drained by the protruding piece 114.

Further, in the foregoing embodiment, the bent portions 111 and 112 are located in the left and right sides of the bottom side end portion of the plate 100 in FIG. 2. However, the bent portions 111 and 112 may be located in only an upstream side of the air conditioned duct 10 at least. Thus, when the bent portions 111 and 112 are located at the upstream side of the air conditioning duct 10 at least, an opening portion between the air conditioning duct 10 and the evaporator 6 is closed by the bent portions 111 and 112, and therefore, the air from the blowing mean 14 can entirely pass through the evaporator 6.

In this case, it is needless to say that the protruding piece is located in an area without the bent portions 111 and 112 of the bottom side end of the plate 100, and the condensed water is effectively drained from the protruding piece. Further, in this case, when the plate 100 is formed such that the condensed water which is generated on the surfaces of the plate 100 and the fin 123 flows together on a portion where the bent portions 111 and 112 are not provided while avoiding the bent portions 111 and 112, the effect for preventing rust on the evaporator 6 is improved.

Further, the bent portions 111 and 112 are only located in the center portion of the bottom end portion of the plate 100 in FIG. 2 and not in each of the left and right sides, and the protruding piece may be located in each of the left and right sides of the bottom side end portion of the plate 100 in FIG. 2. Further, at this time, when the plate 100 is formed such that the condensed water which is generated on the surfaces of the plate 100 and the fin 123 can flow together in the left side or right side while avoiding the bent portions 111 and 112 of the center portion, the effect for preventing rust on the evaporator 6 is improved.

Further, in the foregoing embodiment, by providing the protruding pieces 113 and 114 which protrude downwardly a predetermined distance from the position shown by the double-dashed line B in FIG. 5 in the lower end portion of the connecting body 400, the extending portion for draining the condensed water is constructed. However, without specially providing the protruding pieces, when the fin 123 of the connecting body 400 from the bottom end thereof over a predetermined distance is removed, the extending portion for draining the condensed water can be constructed in this portion. It is needless to say that the protruding piece may be located in the lower end portion of this portion.

The present invention having been described should not be restricted to the above described embodiments but may be modified in many other ways without departing from the spirit of the invention.

What is claimed is:

1. A laminated type heat exchanger comprising:

a plurality of connecting bodies, each of which is formed by connecting a pair of pressed plates face-to-face to form a refrigerant passage therein;

an inlet tank portion protruding from said connecting body toward its top end side thereof for directing a refrigerant into said refrigerant passage, said inlet tank portions of each of said connecting bodies communicating with each other;

an outlet tank portion protruding from said connecting body toward its top end side thereof for discharging the refrigerant from said refrigerant passage, said outlet tank portions of each of said connecting bodies communicating with each other;

a U-shaped tube formed within said connecting body for directing the refrigerant from said inlet tank portion to said outlet tank portion;

a bent portion partially provided on a bottom portion of said connecting body, said bent portion being bent nearly perpendicular to a bottom surface of said connecting body;

a fin provided between each adjacent pair of said connecting bodies at a lower side of said inlet tank portion and said outlet tank portion and at an upper side of said bent portion;

an extending portion provided on said bottom portion of said connecting body on a portion other than said bent portion so as to extend to a side lower than a bottom end portion of said fin a predetermined distance; and guide means provided on a surface of said connecting body for guiding condensed water generated on a surface of said connecting body toward said extending portion while avoiding said bent portion.

2. A laminated type heat exchanger according to claim 1, wherein said guide means is a guide groove formed on said surface of said connecting body.

3. A laminated type heat exchanger according to claim 2, wherein said guide groove is slanted from an end side in the width direction of said connecting body toward a center position of said connecting body.

4. A laminated type heat exchanger according to claim 2, wherein said pair of pressed plates are connected face to face at each back side surface of a surface where said guide groove is formed.

5. A laminated type heat exchanger comprising:

a plurality of connecting bodies, each of which is formed by connecting a pair of pressed plates face-to-face to form a refrigerant passage therein, each plate including an inlet hole formed in an upper portion thereof, an outlet hole formed in an upper portion thereof, depressions formed in an entire surface thereof, a partition rib for partitioning said inlet hole and said outlet hole, a bent portion formed at each side of a bottom portion thereof so as to be bent perpendicularly, an inlet tank portion formed by connecting said inlet holes of said connecting bodies for directing a refrigerant into said refrigerant passage;

an outlet tank portion formed by connecting said outlet holes of said connecting bodies for discharging the refrigerant from said refrigerant passage;

a U-shaped tube formed within said connecting body by said depressions and said partition rib for directing the refrigerant from said inlet tank portion to said outlet tank portion;

a fin provided between each adjacent pair of said connecting bodies at a lower side of said inlet tank portion and said outlet tank portion and at an upper side of said bent portion; and an extending portion provided on said bottom portion of said connecting body other than said bent portion so as to extend to a side lower than a bottom end portion of said fin a predetermined distance, wherein each of said pressed plates includes a guide groove for guiding condensed water generated on a surface of said connected body toward said extending portion while avoiding said bent portion.

* * * * *